United States Patent [19]

Ensign

[11] 3,957,395

[45] May 18, 1976

[54] METHOD AND APPARATUS FOR CONTROLLING A PUMP

[75] Inventor: Harold W. Ensign, Fullerton, Calif.

[73] Assignee: Cla-Val Co., Costa Mesa, Calif.

[22] Filed: Nov. 25, 1974

[21] Appl. No.: 526,716

[52] U.S. Cl. ..... 417/12; 417/28; 417/29; 417/279; 417/53

[51] Int. Cl.[2] ..... F04B 49/00; F04B 49/02; F04B 49/06; F04B 49/08

[58] Field of Search ..... 417/12, 53, 299, 27, 417/28, 279, 290, 295

[56] References Cited

UNITED STATES PATENTS

| | | | |
|---|---|---|---|
| 1,280,477 | 10/1918 | Hopkins | 417/299 |
| 1,980,799 | 11/1934 | Hardosty | 417/12 |
| 2,362,724 | 11/1944 | Shea | 417/299 |
| 3,012,510 | 12/1961 | Kusner | 417/316 |
| 3,118,466 | 1/1964 | Bagwell | 417/299 |
| 3,217,653 | 11/1965 | Griswood | 417/316 |
| 3,299,817 | 1/1967 | Walter et al. | 417/12 |
| 3,602,610 | 8/1971 | Bloom et al. | 417/12 |
| 3,663,831 | 5/1972 | Cook | 417/12 |
| 3,814,541 | 6/1974 | Dent | 417/7 |

*Primary Examiner*—William L. Freeh
*Attorney, Agent, or Firm*—Gausewitz, Carr & Rothenberg

[57] ABSTRACT

A safety control system for a pump and anti-surge valve protects the pump, the valve and the hydraulic main line system. The valve is controlled by a pressure responsive circuit and, via a limit switch on the valve, controls both the steady state running of the pump and the pump start. A timed start circuit allows pressure to build up sufficiently to operate the valve upon initiation of pump operation. The system automatically shuts down upon power, mechanical or hydraulic failure, and prevents continued operation of the pump control valve when the pump has lost suction or there is a decrease in pump discharge pressure.

28 Claims, 5 Drawing Figures

METHOD AND APPARATUS FOR CONTROLLING A PUMP

BACKGROUND OF THE INVENTION

Various types of pumps such as booster pumps and deep well pumps, for example, normally tend to introduce starting and stopping liquid surges. Start up of such a pump may introduce a suddenly increased pressure into the main line system creating an undesirable surge. Particularly in a deep well pump at least sections of the line at the discharge side of the pump may be partly filled with air and, upon startup of the pump, it is common to discharge the initial mixture of air and liquid to the atmosphere. When such venting is completed, and a venting valve closed, the rapidly flowing liquid may suddenly impinge upon liquid in the mainline system, creating a significant and undesirable shock and surge. A similar shock and surge will occur upon startup of a booster pump.

When such pumps are shut down, momentum of flowing liquid may create a decreased pressure or suction effect in the vicinity of the pump discharge. System liquid, no longer subject to the pump pressure, will continue to flow for a short time, then will return toward the pump, and will surge back and forth.

To avoid such surging, pumps are often connected to operate together with an anti-surge valve or a pump control valve, which, in effect, isolates the mainline hydraulic system from the pump during pump start and stop periods. For example, in a booster pump, a valve is provided to receive discharge of the pump and is maintained in a closed condition, isolating the mainline system from the pump discharge, when the pump is started. Upon start of the pump, the valve begins to open, and opens slowly, to allow pump discharge pressure to be relatively slowly and gradually transmitted to the mainline hydraulic system. Conversely, the valve is caused to begin to close, and closes slowly, before the pump is stopped. Thus, the pump pressure is gradually removed from the system and surge is avoided.

For deep well pumps, the operation is similar but the anti-surge valve is the vent valve and is open when the pump is started to connect the pump discharge to the atmosphere. When the pump is started, this anti-surge vent valve begins to close and, as it begins to close, the main valve connecting the pump discharge to the mainline hydraulic system begins to open. In the deep well pump, a stop command to the pump does not stop the pump but rather begins the opening of the vent valve and the pump is stopped only after such valve has opened to a significant degree.

Such an anti-surge valve and pump system for a booster pump is described in U.S. Pat. No. 2,384,420 to D. G. Griswold, assigned to Clayton Manufacturing Co., the predecessor of the assignee of the present invention. Such assignee presently manufactures such pump control valves. A typical booster type pump control valve is identified as Clayton Model No. 60P-1A (Globe) and a typical deep well type pump control valve as identified as Clayton Model No. 61P-2A (Globe), both manufactured by Cla-Val Co. of Newport Beach Calif., the assignee of the present invention.

It is found that buyers of these valves may not always connect the valve for proper electrical operation. Further, certain types of system failures have occurred with the use of this type of pump control or anti-surge valve. Thus, because of damage to the equipment, improper connection, or certain types of system failures, it is possible that the pump will start and continue to run even though, for example, the booster type pump control valve fails to open. This may result in severe damage to the pump and motor.

Other problems can occur. The pump may continue to run or the valve may continue to be in its operating condition even if there is a mechanical or hydraulic failure. A temporary power failure may allow an automatic restart upon resumption of power even though the valve (in a booster pump, for example) is still open and has not yet closed. Where the pump loses suction or discharge pressure decreases below a selected value, the pump may continue to run and the valve (such as the booster valve, for example) may remain open. In certain deep well pump operations, the initially open vent valve may close before the fully liquid (without intermixed air) discharge of the deep well pump reaches this valve.

Any of these possibilities can result in severe damage to the system or its components. Nevertheless, there has been devised no safety control system to adequately handle such potentially damaging conditions.

Accordingly, it is an object of the present invention to control a pump control valve and pump so as to avoid or eliminate the above-mentioned problems.

SUMMARY OF THE INVENTION

In carrying out principles of the present invention in accordance with a preferred embodiment thereof, the pump is started only when the valve is in a first position and is run in a steady state operation only when the valve is in another position. The valve is operated only when pressure of fluid provided to the valve from the pump is above a selected level. A timed start circuit is provided to allow such pressure to build up during pump start. More specifically, according to a feature of the invention, a valve actuated limit switch controls a pump initiating circuit and a timer establishes a start interval for a timed start circuit. Sensed pressure, at an acceptable level, operates to maintain the valve in a steady state run condition so that a limit switch on the valve will hold the pump in a steady state run condition.

DETAILED DESCRIPTION

Figure 1:
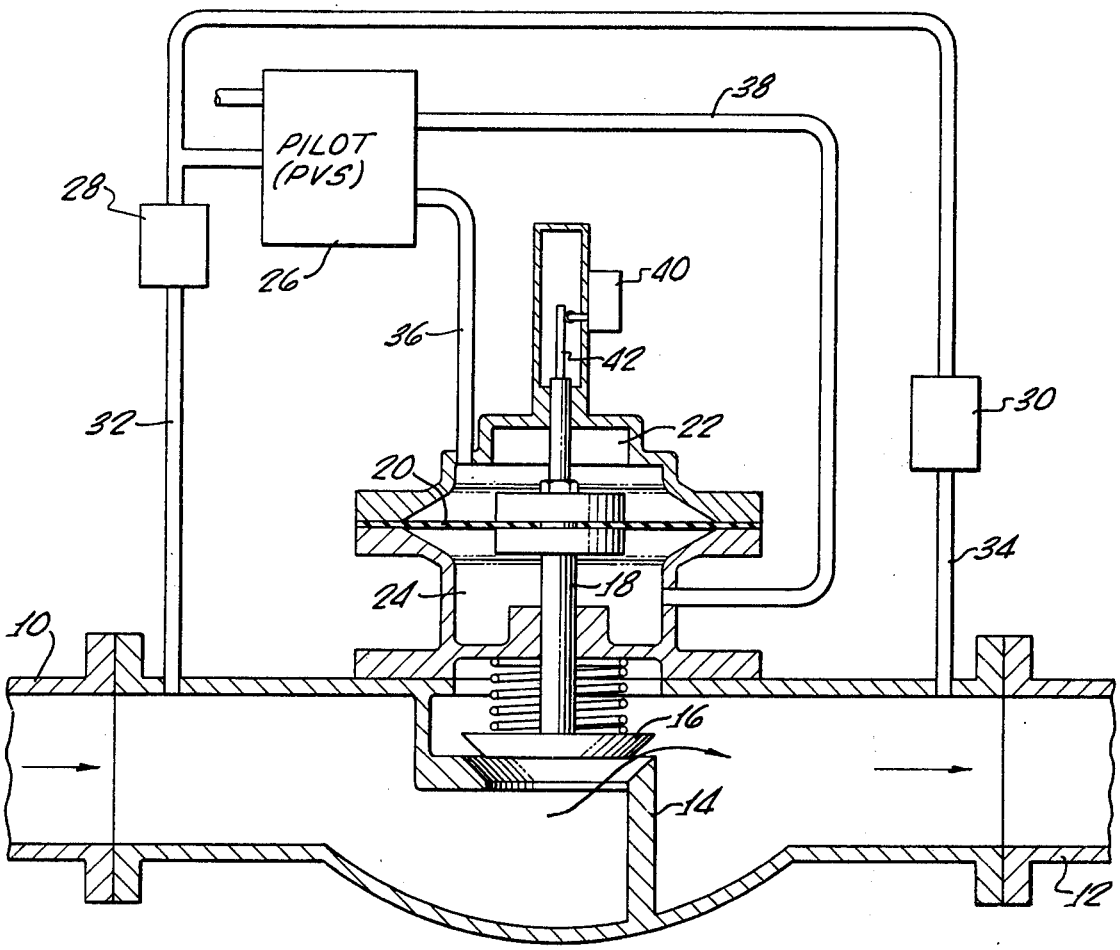
FIG. 1 is a diagrammatic illustration of a booster-type valve embodying certain elements of the control system of this invention.

Schematically illustrated in FIG. 1 are major components of a booster pump control valve of the type generally illustrated in the aforementioned U.S. Pat. No. 2,384,420 and presently sold by the assignee of the present invention as a Clayton booster type pump control valve Model 60P-1A (Globe). The valve of FIG. 1 controls flow of fluid from a pump (not shown in FIG. 1) via an upstream pipe 10 to a downstream pipe 12 and includes a valve seat 14 cooperating with a movable valve closure member 16 that is operated by a valve shaft 18. Valve shaft 18, in turn, is operated by a diaphragm 20 that is driven either upwardly or downwardly (as viewed in FIG. 1) in accordance with the pressure differential in first and second valve operator chambers 22, 24 on either side of the diaphragm 20. Pressure in the valve operator chambers 22, 24 is controlled by a valve controller in the form of a pilot valve solenoid 26. Valve controller 26 receives liquid under pressure via check valves 28 and 30 respectively from a conduit 32 connected to the upstream pipe 10 and from a conduit 34 connected to the downstream conduit 12. Pilot valve solenoid or valve controller 26 includes a solenoid that switches the pilot valve between energized and de-energized conditions. In this booster pump arrangement, the pilot valve solenoid, when de-energized, feeds a relatively high pressure to chamber 22 via line 36. The pilot valve and line 38 connect the chamber 24 to a low pressure or atmosphere. This keeps the valve (14, 16) closed. When the solenoid of the valve controller 26 is energized, high pressure from the upstream pipe 10 is fed via line 32 through check valve 28 and through the pilot valve and line 38 to the chamber 24. Upper chamber 22 is connected via line 36 and the pilot valve solenoid, when energized, to a lower pressure or the atmosphere. Thus the valve (14, 16) begins to open under control of diaphragm 20 and valve shaft 18, when the pilot valve solenoid is energized.

Limit switch 40 is connected to be operated by an upper extension 42 of the valve shaft 18 so that the switch is in one position when the closure member 16 contacts the seat 14 to close the valve and is in another position when the closure member 16 raises a small amount to begin to open the valve (14, 16).

Figure 2:
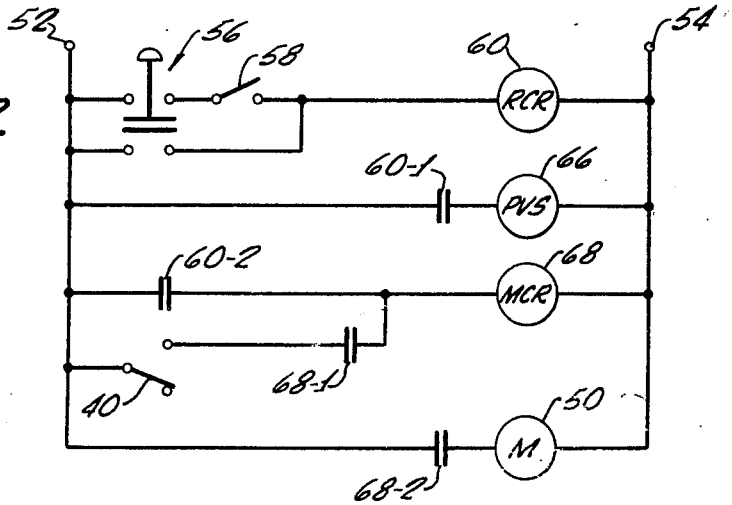
FIG. 2. PRIOR ART
FIG. 2 illustrates a prior art control circuit for the valve of FIG. 1.

The system pump (not shown in FIGS. 1 and 2) is under control of a motor 50, shown in FIG. 2 in a prior control system. This prior control system includes a pair of power input terminals 52, 54 which energize a first circuit including a remote control and manual start selector 56 and a remote control switch 58. Energization of these switches, manually or remotely, energize the coil 60 of a run command relay (RCR) having normally open run command contact pairs, 60-1 and 60-2 connected to be closed when coil 60 is energized. Contacts 60-1 operate (when closed) in a second circuit to energize a solenoid coil 66 (PVS) of the pilot control or valve controller 26 of FIG. 1. When this circuit is energized by operation of switches 56, 58, the pilot valve solenoid coil 66 is energized to begin opening the normally closed valve 14, 16 of FIG. 1. Concomitantly, contacts 60-2 energize a third circuit in which is connected the coil 68 of a motor control relay (MCR) having first and second normally open contacts 68-1, 68-2 connected to be closed upon energization of coil 68. Thus, upon the run command achieved by operation of switches 56, 58, both coils 60 and 68 are energized and contacts 68-2 are also energized to establish a fourth circuit having the motor 50 connected therein.

As the valve 14, 16 moves from its normally closed position, the normally open contact limit switch 40 is closed to establish a circuit including the contacts of limit switch 40, the closed contacts 68-1 and the motor control relay coil 68, to thereby latch the motor in a steady state run condition. The motor is connected to drive the pump.

To stop the pump, under control of the prior circuit of FIG. 2, switches 56, 58 are operated to de-energize coil 60 and open contact 60-1, 60-2. Opening contacts 60-1 de-energizes the pilot valve solenoid coil 66 and the anti-surge valve 14, 16 begins to close. Nevertheless, the motor continues to run because the motor control relay coil 68 is latched by the still closed limit switch 40 and the still closed motor control relay contacts 68-1. Only when the valve closure member 16 attains a nearly closed condition, do the contacts of the limit switch 40 open thereby de-energizing the motor control relay coil 68 and opening the contacts 68-2 to the motor.

Figure 3:
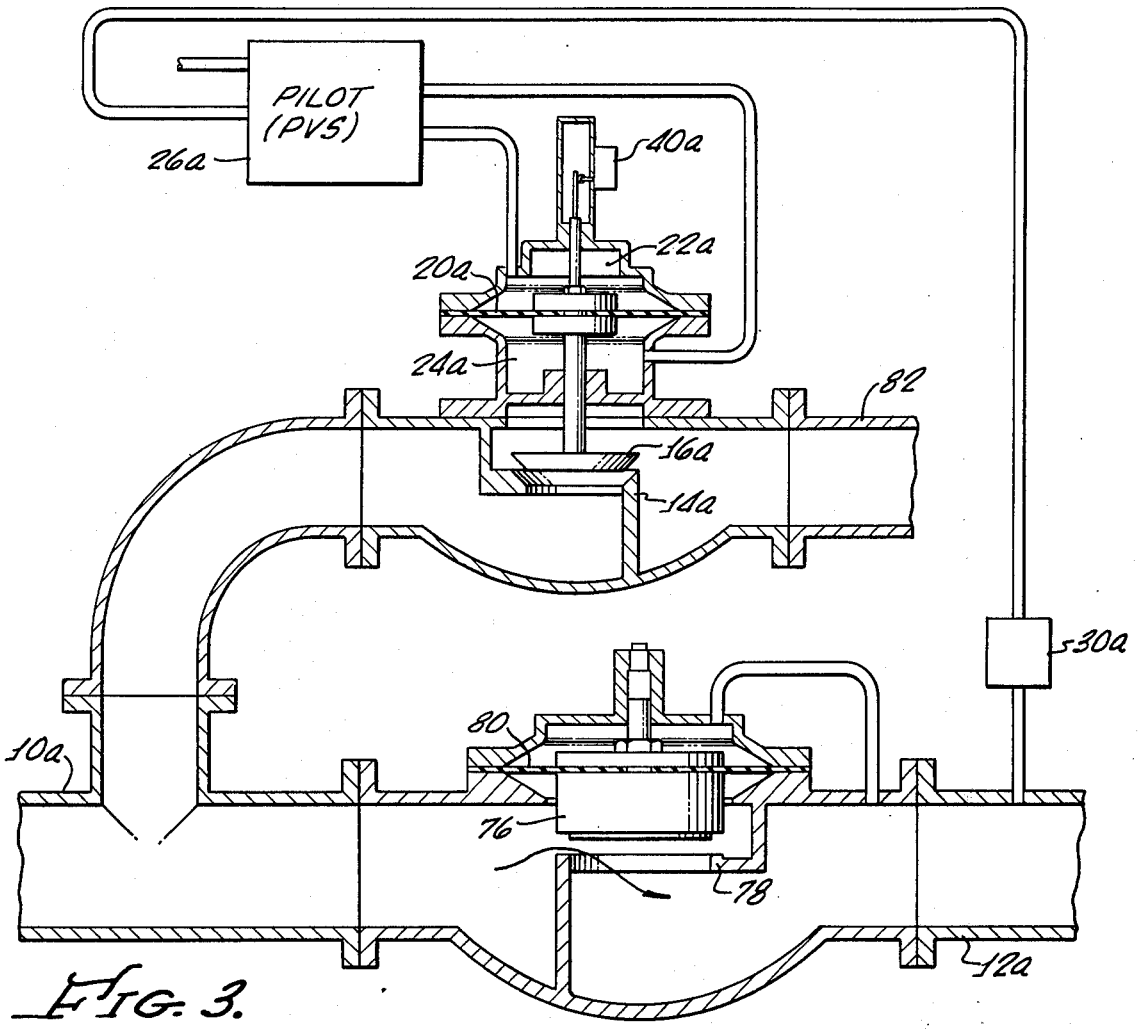
FIG. 3 is a diagrammatic illustration of an anti-surge valve connected for use with a deep well pump.

A valve substantially similar to that of FIG. 1 is illustrated in FIG. 3 and is arranged for use with a deep well pump (not shown) that provides pressurized fluid from its discharge side to the upstream pipe **10*a* and thence through a main flow control valve having a closure member 76 and a valve seat 78 to a downstream pipe 12*a*. Closure member 76 is connected to be operated by pressure difference on the two sides of the valve 76, 78. When the pump is off, downstream pressure in conduit 12*a*, which is connected to the hydraulic mainline system, is a higher pressure and, via a valve operating diaphragm 80, forces closure member 76 into a closed position. When the pump is operating, the upstream side of the main valve 76, 78 has a higher pressure to thereby open the valve 76, 78. Parts of the valve of FIG. 3 that correspond to parts of the valve of FIG. 1** are designated by the same reference numbers, but with the suffix *a*.

In this deep well pump arrangement, the pump is started with the pump control valve in open condition to flow a mixture of liquid and air, initially discharged from the starting pump, from the system to the atmosphere via a conduit 82. The anti-surge valve for control of the deep well pump is substantially identical to the valve of FIG. 1 but its closure member **16*a* is initially open (when the pump is off), and the valve controller is de-energized with the lower chamber 24*a* adjacent the valve operating diaphragm 20*a* having a higher pressure than the upper chamber 22*a*. This drives the closure member 16*a* to its upper or open position. According to previous practice, when the pump is started, the valve controller or pilot valve solenoid 26*a* is energized to start the closing of valve closure member 16*a* by producing a higher pressure in chamber 22*a* and a relatively low pressure in chamber 24*a*. As valve 16*a* begins to move from its open position, limit switch 40*a* closes to establish and latch a motor control relay circuit similar to circuit of FIG. 2 and including limit switch 40*a*, contacts 68-1 and motor control relay coil 68 of FIG. 2. As valve member 16*a* closes, pressure increases at the upstream side of main valve 76, 78 which then opens, as valve member 16*a* reaches its final closed position, and the system continues with the pump running in such a steady state condition. When the pump run command is removed, pilot valve solenoid 26*a* is de-energized and closure member 16*a* begins to raise, to open the pump control valve 16*a*, 14*a*. As the closure member 16*a* nears its fully opened position, limit switch 40*a*** disables the motor control relay latch circuit and the motor and pump stop.

The system and controls described above have been used for some time, but are subject to several problems, as previously mentioned. With the above-described prior system, it is possible to start the pump with the control valve in the wrong position (open for a booster pump, or closed for the deep well pump). If the pump loses suction or discharge pressure, or a pump shaft is broken, the system or at least those parts still operable may continue to run. In case of a power failure, this prior system may begin its stop cycle, but if power should return before the control valve has fully closed in the booster pump, or before the control valve has fully opened in the deep well pump, the pump may restart and subject the hydraulic mainline system to an undesired starting surge. It may be noted that the valves described above may take about four to five minutes to move from one position to the other. The rate of closure and the rate of opening of the valves are controlled by throttling and rate control valves (not shown) that are connected in the lines between the valve controllers 26, 26*a* and the chambers 22, 24, and 22*a*, 24*a*.

In the deepwell pump, as controlled according to prior art, it is possible that the control valve may close before all of the mixture of air and liquid in the line between the valve and the discharge side of the pump has been fully vented to the atmosphere. In the prior system, this time of closing is not readily controllable.

Figure 4:
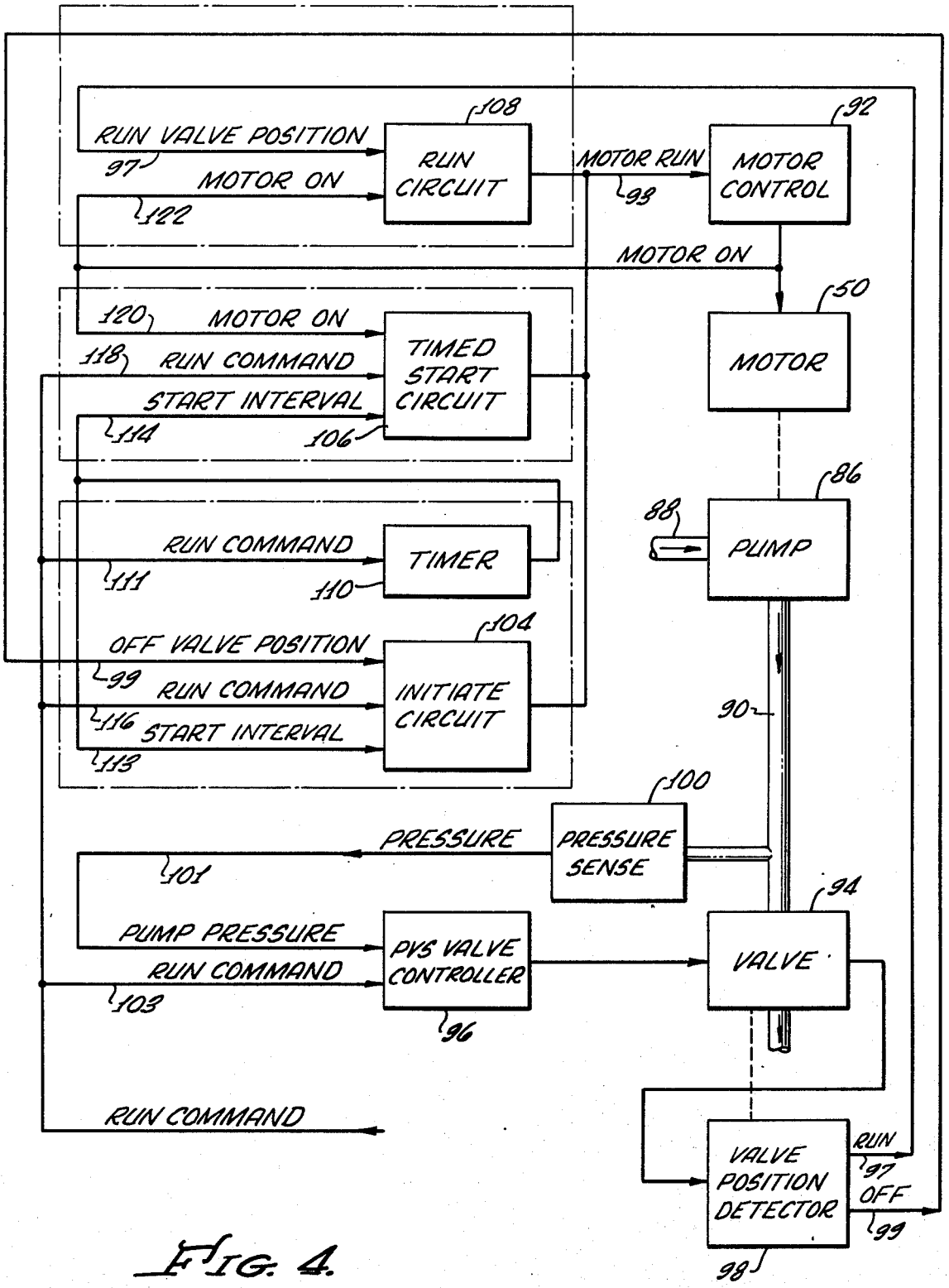
FIG. 4 is a functional block diagram of motor, pump, and valve control system embodying principles of the present invention.

To eliminate these problems in prior systems, to provide a safety control that avoids incorrect and potentially dangerous operation of the system in the presence of certain hazards and failures, and to provide generally improved functioning of the system, principles of the present invention are employed to control the pump and valve as illustrated in FIG. 4. A system pump 86, having an input side 88 and a discharge side 90, is driven by a motor 50 under control of a motor control 92. Pump 86 feeds fluid under pressure to a control valve 94 which may be a booster control valve of the type illustrated in FIG. 1 or a deep well control valve of the type illustrated in FIG. 3. Valve 94 is operated between its open and closed positions by a valve controller 96 which is a conventional solenoid controlled pilot valve, of the type normally employed with the above identified Cla-Val valves. A valve position detector in the form of a limit switch 98 is connected with the valve 94 to send an electrical signal representing the sensed position of the valve. When the valve is in one position, closed for the booster pump or open for the deep well pump, it sends a "run" signal via a line 97, and in the other position the detector 98 sends an "off" signal via a line 99.

A pressure detector 100 is connected to sense fluid pressure at a point between the discharge side of the pump and the input of the valve, preferably adjacent the input side of the valve 94. Detector 100 provides a signal on a line 101 when the sensed pressure is at or above a pre-determined pressure level. The valve controller 96 receives a first input on line 101 representing sensed pressure and a second input on a line 103 representing a run command which is a manually or remotely provided command signal to operate the pump.

Motor control 92 is operated by a motor run signal on a line 93 which is provided by one or more of three different circuits at different conditions of operation. Thus, the motor run signal is provided by (a) an initiate circuit 104, (b) a timed start circuit 106, and (c) a steady state run circuit 108. A timer 110 is provided to generate a time interval for system start.

Upon occurrence of a run command signal, a run command input to timer 110 via a line 111 starts a time interval to provide a start interval input on lines 113 and 114 to the initiate circuit 104 and to the timed start circuit 106. The initiate circuit 104 also receives inputs from the run command on line 116 and from the valve position detector on line 99 (indicating position of the valve when the system is not running). The timed start circuit 106 receives a run command input on line 118 and a motor on input on a line 120 from the output of the motor control relay 92 when the latter is energized to drive the motor 50.

The steady state run circuit 108 has a motor on input on a line 122 from the motor control 92 when the latter is energized to drive the motor, and also has a second input on line 97 from the valve position detector 98, indicating that the valve is in the run position (open for the booster pump and closed for the deep well pump).

Operation of the control system of FIG. 4 will be described with respect to a booster pump such as shown in FIG. 1. Valve 94 is initially closed and valve controller 96 is de-energized. Low pressure is sensed by pressure sensor 100. Position detector 98 detects the off position of the valve. Motor control 92 is de-energized, motor 50 is not running and the pumps 86 is off. A run command actuates the timer 110 to initiate the start time interval and further provides a first input to both the initiate circuit 104 and the timed start circuit 106. The latter, however, still lacks an input on line 120 since the motor control 92 has not yet been energized. Run circuit 108 is also not energized at this time because the valve is in its off position. However, initiate circuit 104 receives all of its three required inputs, the start interval from the timer, the run command and the off valve position and accordingly, motor control 92 is energized from circuit 104 to start motor 50 and to drive pump 86. Timed start circuit 106 is established (enabled) as soon as the motor control 92 is energized, receiving its motor on input on line 120, the run command on line 118 and the start interval on line 114.

Initially pressure of the discharge side of pump 90 is low and no input to valve controller 96 is provided from the pressure sensor 100, whereby the valve controller initially remains de-energized and the valve 94 remains in its off position, while the motor and pump begin to run.

As soon as the pressure at the input of valve 94 reaches the predetermined level, this is detected by the pressure sensor 100, and valve controller 96 receives its second input. Controller 96 is accordingly energized, whereupon valve 94 begins to move from its off position to its run position. As the valve moves from its off position, valve position detector 98 senses displacement of the valve. The initiate circuit 104 is now disabled because it no longer receives an off valve position signal. However, run circuit 108 which is receiving a motor on input from motor control 92 now receives a run valve position signal from the position detector and this steady state run or latch circuit is now established to operate the motor control.

At the end of the start time interval provided by timer 110, timed start circuit 106 is disabled but is no longer needed since the steady state run circuit 108 is now energizing the motor controller 92. However, if valve 94 had failed to open even though the motor control 92 had been energized and the motor and pump were operating, the timed start circuit 106 would be disabled at the end of the start time interval and the motor control 92 would thereupon be de-energized. Initiate circuit 104 is also de-energized at the end of the start time interval because it requires a start interval input on line 113. Further, the steady state run circuit 108 is not energized if the valve does not move to its run position. In prior circuits, the motor control 92 is operated directly by the run command and thus will drive the motor regardless of valve position.

Assuming the run circuit 108 is established and the system is running in steady state condition, it will continue to do so only as long as the run command continues and the pressure at the input to valve 94 as detected by pressure sensor 100 remains above a preselected value.

To stop the system, the run command is removed, thereby de-energizing valve controller 96 which starts to move the valve 94 from its run position to its off position. However, the motor and pump continue to run until the valve has almost reached its off position, at which time the run valve position input to run circuit 108 is removed by valve position detector 98 and the motor and pump are stopped.

Should the pressure detected by pressure senso r 100 drop below a pre-determined minimum during operation of the system, valve controller 96 is de-energized. Accordingly, the system will stop in the same manner as it would if the run command is removed.

Should there be an electrical failure during steady state operation, the system must be completely shut down before it can be restarted. In prior control systems, on the other hand, the pump and motor could be restarted upon resumption of power after a power failure, even though the valve had not yet returned to its off position. With the arrangement of FIG. 4, however, run circuit 108 cannot be re-energized until the motor controller 92 is energized once again. The latter cannot be initially energized by the run circuit nor by the timed start circuit, both of which require the motor control to be on. Start and restart can be controlled only by the initiate circuit 104. Since this circuit is under control of the valve position detector and can be established only when the valve is in the off position the system cannot be restarted until it has been entirely shut down.

It will be understood that the control concepts of the present invention are merely functionally illustrated in FIG. 4 and can be implemented by various electrical and electromechanical control elements and devices well known in the art. Thus, the timer and the three motor control energizing circuits 104, 106 and 108, may be all or partly provided by conventional electronic components such as solid state semi-conductor logic. Alternatively, these may be provided by control relays. A system of the latter type is selected for purposes of illustration and shown in FIG. 5.

A plurality of circuits are provided between electric power input terminals 126, 128. A run command circuit for energizing a run command relay (RCR) coil 130 is operable by a manual run command provided by a remote/manual selector switch 132 or a remote switch 134 so that the coil 130 may be manually energized by moving switch 132 to its lower position or by remote operation of switch 134 with the selector switch 132 in its upper position. An indicator light 136 is connected to provide a visible indication of remote operation of the circuit.

A valve controller circuit including the solenoid 138 of the pilot valve (PVS) is connected in circuit with a first set of normally open contacts 130-1 that are operated by coil 130. Also connected in the circuit of solenoid 138 is a pressure switch 142 that is open when the pressure at its sensing input is below a predetermined value and closed when the pressure is at or above its predetermined value.

A time delay relay (TDR) 144 is connected in a time interval circuit with a second set of normally open contacts 130-2 that are operated by the run command relay coil 130. Time delay relay 144 operates a set of normally closed contacts 144-1 to cause these contacts to open a predetermined time interval after energization of the coil of the time delay relay. A motor control relay (MCR) coil 150 is connected to be energized by three different circuits as described above in connection with FIG. 4. The first of these circuits is the initiate circuit and includes a limit switch 152 in its illustrated normally closed position, the normally closed time delay relay contacts 144-1 and a third set of normally open contacts 130-3 connected to be closed by energization of the run command relay coil 130.

A second or timed start circuit for energization of the motor control relay coil 150 comprises the normally closed time delay relay contacts 144-1, the third set of run command relay contacts 130-3 and a first set of normally open motor control relay contacts 150-2 that are connected to be closed by energization of motor control relay coil 150.

The steady state run circuit for motor control relay coil 150 comprises limit switch 152, when it moves to its run position (the unillustrated position of FIG. 5), and a second set of normally open contacts 150-1 connected to be closed upon energization of the motor control relay coil 150.

A third set of normally open contacts 150-3 connected to be closed by energization of motor control relay coil 150 is connected in circuit with the motor 50 and with an indicator light 162 which is energized whenever the motor is energized to provide a visual indication of the motor on condition.

Figure 5:
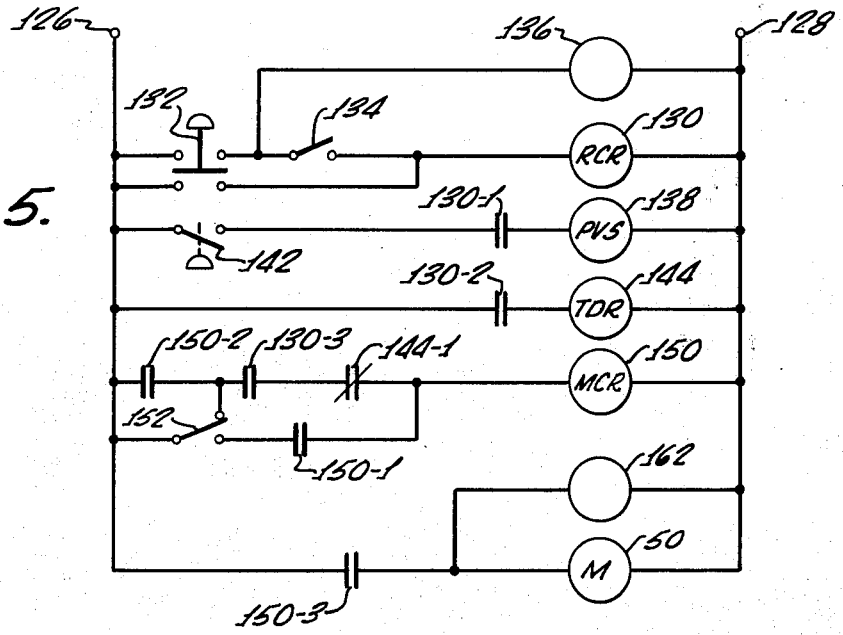
FIG. 5 is a schematic circuit diagram of certain control elements of the pump and valve controller.

The relay control circuit of FIG. 5 operates just as previously described in connection with the functional diagram of FIG. 4 and will control either the booster type pump control valve or the deep well type pump control valve. The system will automatically shut down in the absence of appropriate pressure at the input side of the valve. It will provide a delay upon start to allow the pressure to build up. It will start to operate the pump control valve to its run position only after pressure has reached its selected value and only with the control valve in its off position. Further, if the valve does not move to its run position, the system will stop after a start time interval.

Where the system of FIG. 5 is applied to a booster pump, a starting cycle is initiated by closing switch 132 (manual operation) or both switches 132 and 134 (remote operation) to energize coil 130 thereby closing run command relay contacts 130-1, 130-2 and 130-3. Solenoid coil 138 is not yet energized because pressure switch 142 has not yet sensed its preset pressure level. Time delay relay 144 is energized and the start time interval commences. Normally closed contacts 144-1 remain closed during the start time interval and open at the end of this interval. Motor control relay coil 150 is energized by the initiate circuit including limit switch 152 in the illustrated off position, contacts 130-3 and normally closed contacts 144-1. Upon energization of motor control relay coil 150, its contacts 150-1, 150-2 and 150-3 close. This energizes the timed start circuit including contacts 150-2, contacts 130-3 and still closed contacts 144-1.

Upon build up of pressure, switch 142 closes to energize solenoid 138 of the valve controller and the pump control valve begins to open. As the valve opens slightly, switch 152 moves to its other position to establish the run control circuit including limit switch 152 and now closed contacts 150-1. Just after the valve begins to open the initiate circuit is disabled. As soon as the start time interval terminates, the timed start circuit is disabled. Now the pump continues to run on the run circuit including limit switch 152 and contacts 150-1. If the valve had not opened after receipt of the run command, the run circuit (limit switch 152 and contacts 150-1) would not have been established and at the end of the start time, the system would have shut down. Further, if the pressure had not risen to the preset level, the valve controller coil 138 would not have been energized and the valve would remain closed, whereupon at the end of the start time interval the system would shut down.

During steady state run under control of the run circuit, including limit switch 152 and motor control relay latching contact 150-1, the system continues to run and will stop upon command or upon the occurrence of certain failures. If pressure should be lost as by loss of suction or a broken pump shaft, for example, pressure switch 142 opens, de-energizing the solenoid of the valve controller, thereby driving the pump control valve toward its closed position, operating limit switch 152 and de-energizing the run circuit.

Upon occurrence of an electrical failure, all relay coils are de-energized. All relay contacts moved to their de-energized position and the valve begins to close. If power should be resumed before the valve is fully closed, the system will not restart. As previously described, it is undesirable to start the system unless the valve is closed. However, when the time delay relay is de-energized contacts 144-1 close and, upon re-establishment of power after a momentary power failure, contacts 130-3 of the timed start circuit also close. However, the motor control relay contacts 150-2 do not close unless the motor control relay coil 150 has been energized again. But the latter cannot be energized unless and until the valve has completely closed, to move limit switch 152 to the illustrated position and establish the initiate circuit.

In a commanded stop, the command circuit is disabled by opening one or the other of switches 132, 134, thereby de-energizing run command relay coil 130 and opening its contacts 130-1, 130-2 and 130-3. Pilot valve solenoid 138 is de-energized and the control valve starts to close. The pump is still being driven because the motor is still energized by the run circuit including limit switch 152 and contacts 150-1. Limit switch 152 remains in its run position (unillustrated in FIG. 5) until the valve has almost closed. Then it switches back to the position illustrated, de-energizing the run command circuit and stopping the motor and pump.

The circuit of FIG. 5 is also applicable to the deep well pump illustrated in FIG. 3. Operation, including start cycle, stop cycle and its protective functioning is substantially same as that described for the booster type. However, as previously indicated, the deep well type pump control valve is initially open and begins to close only after the motor and pump have been started and pressure, as detected by pressure switch 142 at the input of the valve, has reached the predetermined level. This feature is particularly useful with the deep well pump to ensure that the pump control valve does not close prematurely.

Although the invention has been described and specifically illustrated in connection with booster type and deep well type pumps and control valves therefor, it will be readily appreciated that principles of the invention may be applied to other types of pump and valve systems wherein a desired sequencing of pump and valve operations is required for start or stop or where other system protective features are useful.

The foregoing detailed description is to be clearly understood as given by way of illustration and example only, the spirit and scope of this invention being limited solely by the appended claims.

What is claimed is:

1. A pumping system comprising a a pump having an inlet and discharge side, a valve having an inlet connected to the discharge side of said pump and having an output side, said valve being operable between first and second positions, one of said positions being a closed position and the other of said positions being an open position, pump stop means for initiating movement of said valve from said first position to said second position, means responsive to attainment by said valve of a position near said second position for stopping said pump, start means for initiating movement of said valve from said second to said first position, and means for preventing said pump from starting unless said valve is in said second position.

2. The system of claim 1 wherein said means for preventing said pump from starting comprises detecting means for detecting valve position and pump initiating means responsive to said detecting means.

3. The system of claim 2 wherein said detecting means comprises a switch connected to be operated by said valve and wherein said initiating means comprises an electrical circuit having said switch connected therein.

4. The method of operating a pump and valve having open and closed positions, comprising the steps of causing said pump to run in a steady state run condition when and only when said valve is in one of said positions, and causing said pump to start when and only when said valve is in the other of said positions.

5. The method of claim 4 including the step of allowing said pump to run for only a limited start period when said valve is in said other position.

6. The method of claim 4 wherein said step of causing the pump to start comprises the steps of initiating running of the pump when the valve is in said other position, establishing a limited time delay starting circuit, and running said pump on said limited time delay starting circuit for a limited period of time.

7. The method of claim 6 including the step of controlling position of said valve in response to pressure of fluid pumped by said pump toward said valve.

8. In a fluid pumping system having a pump connected to initially discharge to atmosphere through an initially open valve and a valve control for starting to close the valve when the pump is started, the improvement comprising means for preventing the valve from fully closing before fluid discharged from the pump has reached the valve, said means comprising means for sensing discharge of fluid from the pump, and means responsive to said means for sensing for initiating closing of said valve.

9. The system of claim 8 wherein said means for sensing discharge from said pump comprises means for sensing pressure of fluid between the discharge of said pump and the intake of said valve.

10. The system of claim 8 wherein said means for sensing discharge of fluid from said pump comprises a conduit connected between the discharge of the pump and an input to said valve, a pressure sensor in said conduit, and means responsive to said pressure sensor for actuating said valve control to close said valve.

11. A pump control system comprising a pump having an input side and a discharge side, an anti-surge valve having an input connected to said pump discharge side and having an output, a valve controller, means responsive to said valve controller for moving said anti-surge valve between first and second positions, said anti-surge valve being open in one of said positions and closed in the other of said positions, and means responsive to liquid discharged from said pump for operating said valve controller.

12. The system of claim 11 wherein said means for operating said valve controller comprises a pressure sensor connected to sense pressure of liquid between the input to said valve and the discharge of said pump, said valve controller comprising means responsive to said pressure sensor for driving said anti-surge valve to said first position upon attainment of a pressure greater than a predetermined value in the liquid be between the pump discharge side and the input of said anti-surge valve, and including means for driving said anti-surge valve to said second position when the pressure of liquid between the discharge side of said pump and the input of said anti-surge valve is below a predetermined value.

13. In combination a pump, a motor for driving the pump, a valve connected to receive fluid discharged by the pump and being operable between first and second positions, a run circuit for energizing said motor and thereby driving said pump, said run circuit including means for disabling the run circuit when the valve moves to one of said positions, and a starting circuit for initiating energization of said motor only when said valve is in said one position and thereby initiating driving of said pump, said starting circuit including means independent of said run circuit for disabling said starting circuit while said motor is energized and under control of said run circuit, whereby the motor may continue to drive the pump under control of said run circuit after said starting circuit is disabled and while said valve is in the other of said positions, and whereby said motor cannot be restarted until said starting circuit is enabled.

14. The system of claim 13 wherein said means for disabling said starting circuit comprises means operable in response to movement of the valve to the other of said positions.

15. The system of claim 13 wherein said means for disabling the starting circuit includes a time delay for disabling the starting circuit after expiration of a predetermined time interval.

16. The system of claim 13 wherein said starting circuit includes an initiating circuit and a timed start circuit, said initiating circuit including means for disabling said initiating circuit as the valve moves to said other position, said timed start circuit including means for disabling said timed start circuit after the expiration of a preselected time interval.

17. The system of claim 16 wherein said timed start circuit includes means for disabling the timed start circuit when the motor is de-energized, whereby upon de-energization of said motor the system cannot be restarted unless and until the valve is in said one position.

18. The system of claim 17 including means responsive to pressure at the input side of said valve for driving said valve from one of said first and second positions to the other.

19. The system of claim 18 wherein said means for driving said valve comprises a valve controller, a pressure sensor, and means for operating said controller in response to said pressure sensor.

20. A pump and valve control system comprising in combination a pump having a suction side and a discharge side, a motor connected to drive the pump, a motor control for controlling the motor, a valve operable between first and second positions and having an input connected to the discharge side of the pump, a valve controller connected to operate the valve from one of said first and second positions to the other, position detector means for generating a signal representing position of said valve, means for operating said valve controller to move said valve from one of said positions to the other, an initiating circuit responsive to said position detector means for energizing said motor control only when said valve is in one of said positions, and a run circuit for energizing said motor control only when the valve is in a position other than said one position.

21. The system of claim 20 wherein said means for operating said valve controller comprises means responsive to pressure at the input of said valve.

22. The system of claim 21 including a timed start circuit for energizing said motor control, said timed start circuit including means for energizing said motor control for a predetermined interval of time.

23. The system of claim 22 including means for preventing operating of the timed start circuit in the absence of energization of the motor control.

24. The system of claim 20 wherein the run circuit includes means for energizing said motor control only when the valve is displaced from said one position and the motor control is energized.

25. The system of claim 24 wherein said initiating circuit includes means responsive to said one position of the valve and to a run command for energizing said motor control.

26. The system of claim 23 including means for producing a run command, a timer responsive to said run command for defining a time interval, said timed start circuit including means for energizing said motor control only during said time interval and while said motor is energized.

27. In combination a pump, a motor for driving the pump, an anti-surge valve connected to receive fluid discharged by the pump and being operable between first and second valve positions, a valve controller for driving said valve between said first and second positions and including a solenoid, a run command relay having a coil and first, second and third switches connected to be operated thereby, a command circuit for energizing the run command relay coil, a pressure detector switch connected to be operated when pressure of fluid received by the valve from the pump is above a preselected level, a second circuit connected to energize the solenoid of said valve controller and having said first run command relay switch and said pressure detector switch connected therein, a timer having a timer switch connected to be operated thereby, a third circuit connected to energize said timer and having said second run command relay switch connected therein, a motor control relay having a coil and first, second and third motor control switches connected to be operated thereby, a limit switch connected with said valve for motion between first and second limit switch positions as said valve moves between said first and second valve positions, a run circuit for energizing said motor control relay coil and having said first motor control relay switch and said limit switch connected in circuit therewith, a timed start circuit for energizing said motor control relay and having connected therein said third run command switch, said timer switch, and said second motor control relay switch, an initiating circuit for initially energizing said motor control relay and having said limit switch, said third run command switch, and said timer switch connected in circuit therewith, and a motor energizing circuit having said second motor control relay switch connected in circuit therewith.

28. A pump control system comprising a pump having a discharge side, a valve having an input connected to said pump discharge side and operable between first and second positions, a motor connected to drive said pump, a run circuit for energizing said motor, a start circuit independent of said run circuit for energizing said motor, and valve position means responsive to position of said valve for alternatively enabling either said start circuit or said run circuit in accordance with position of said valve.

* * * * *

UNITED STATES PATENT OFFICE

CERTIFICATE OF CORRECTION

PATENT NO. : 3,957,395

DATED : May 18, 1976

INVENTOR(S) : Harold W. Ensign

It is certified that error appears in the above-identified patent and that said Letters Patent are hereby corrected as shown below:

Column 1, line 61, change first occurrence of "as" to --- is ---; line 63, after "Beach", before "Calif.", insert --- , ---.

Column 6, line 21, change "pumps" to --- pump ---.

Column 10, line 16 (line 1 of claim 1), delete second occurrence of "a".

Column 11, line 36 (line 8 of claim 12), delete "be".

Signed and Sealed this

Fourteenth Day of September 1976

[SEAL]

*Attest:*

RUTH C. MASON
*Attesting Officer*

C. MARSHALL DANN
*Commissioner of Patents and Trademarks*